United States Patent [19]

Sugimoto et al.

[11] Patent Number: 4,865,790

[45] Date of Patent: Sep. 12, 1989

[54] PROCESS FOR PRODUCING AROMATIC POLYESTER FIBER

[75] Inventors: Hiroaki Sugimoto, Takatsuki; Kazuo Hayatsu, Ibaraki; Toshiyuki Kobashi, Okayama; Seiji Takao, both of Okayama; Jun Takagi, Okayama, all of Japan

[73] Assignees: Sumitomo Chemical Company, Limited; Japan Exlan Co., Ltd., both of Osaka, Japan

[21] Appl. No.: 304,864

[22] Filed: Jan. 31, 1989

Related U.S. Application Data

[63] Continuation of Ser. No. 844,976, Mar. 27, 1986, abandoned.

[30] Foreign Application Priority Data

| | | | |
|---|---|---|---|
| Apr. 2, 1985 | [JP] | Japan | 60-69595 |
| Apr. 2, 1985 | [JP] | Japan | 60-69596 |
| Jun. 20, 1985 | [JP] | Japan | 60-135721 |
| Aug. 23, 1985 | [JP] | Japan | 60-186430 |

[51] Int. Cl.[4] ..... D01D 10/02

[52] U.S. Cl. ..... 264/131; 264/211.17; 264/234; 264/345; 427/180; 427/372.2

[58] Field of Search ..... 8/115.68; 264/130, 131, 264/136, 137, 210.3, 211.14, 211.2, 211.17, 234, 345; 427/180, 375, 383.1, 385.5, 389.9, 394, 372.2

[56] References Cited

U.S. PATENT DOCUMENTS

| | | | |
|---|---|---|---|
| 2,318,679 | 5/1943 | Dreyfus | 264/211.20 |
| 3,366,721 | 1/1968 | Burdge et al. | 264/211.14 |
| 3,770,861 | 11/1973 | Hirano et al. | 264/130 |
| 3,778,410 | 12/1973 | Kuhfuss et al. | 260/47 |
| 3,803,284 | 4/1974 | Burghardt et al. | 264/130 |
| 4,058,581 | 11/1977 | Park | 264/136 |
| 4,525,384 | 6/1985 | Aoki et al. | 264/210.3 |

FOREIGN PATENT DOCUMENTS

| | | |
|---|---|---|
| 55-20008 | 5/1980 | Japan . |
| 59-163425 | 9/1984 | Japan . |
| 59-173314 | 10/1984 | Japan . |
| 1507207 | 4/1978 | United Kingdom . |
| 1508646 | 4/1978 | United Kingdom . |

*Primary Examiner*—Hubert Lorin

*Attorney, Agent, or Firm*—Stevens, Davis, Miller & Mosher

[57] ABSTRACT

In a process for producing an aromatic polyester fiber by heat-treating a fiber obtained by melt-spinning an aromatic polyester exhibiting anisotropy in its molten state, an aromatic polyester fiber having high strength and high modulus of elasticity can be produced with suppressed fusion between single filaments during the heat treatment by (a) subjecting the fiber obtained by melt spinning to heat treatment in an organic liquid heating medium or (b) adhering to the fiber obtained by melt spinning at least one member selected from the group consisting of suspensions having a concentration of 0.05 to 20% by weight of organic polymer powders having a melting point or a softening temperature higher than the heat treatment temperature, and suspensions having a concentration of 0.1 to 20% by weight of barium sulfate powder or barium titanate powder, and then subjecting the resulting fiber to heat treatment.

4 Claims, No Drawings

PROCESS FOR PRODUCING AROMATIC POLYESTER FIBER

This application is a continuation of application Ser. No. 844,976, filed Mar. 27, 1986, now abandoned.

FIELD OF THE INVENTION

This invention relates to a process for producing an aromatic polyester fiber having high strength and high modulus of elasticity.

BACKGROUND OF THE INVENTION

It has been revealed in recent years that fibers of high strength and high modulus of elasticity can be produced by melt-spinning an aromatic polyester that exhibits anisotropy in its molten state. This process has various advantages in that no solvent is used and conventional spinning apparatuses can be used in the process. Although such fiber forms a highly oriented and highly crystalline structure and exhibits excellent properties merely by melt-spinning, both the strength and the modulus of elasticity of the fiber can be further improved when the fiber is heat-treated in the vicinity of its softening temperature. However, some fusion among filaments is likely to occur in heat treatment; and once when fusion occurs, since a stress along the fiber axis direction is partly converted to a stress in a direction perpendicular to the fiber axis, the resulting fiber will have a defect characteristic of aromatic polyester fiber in a magnified extent in that although it shows high strength in the fiber axis direction it is eventually very brittle in the direction perpendicular to the fiber axis owing additionally to a weak cohesive force between molecules.

Accordingly, there has been eagerly awaited a means for overcoming the problem of fusion occurring in heat treatment. However, no practically useful means has ever been found yet.

SUMMARY OF THE INVENTION

The object of this invention is to suppress the occurrence of fusion among filaments during heat treatment and to provide eventually a practical process for producing an aromatic polyester fiber having high strength and high modulus of elasticity.

The above-mentioned object of this invention can be achieved by (a) subjecting a fiber obtained by melt-spinning an aromatic polyester which shows anisotropy in its molten state to heat treatment in an organic liquid heating medium or (b) adhering to the said fiber obtained by melt spinning at least one member selected from the group consisting of solutions of a basic compound having a concentration of 0.2 to 20% by weight, suspensions of the same having the same concentration as above, organic polymer powders having a melting point or a softening temperature not lower than the heat treatment temperature, barium sulfate powder, and barium titanate powder and then subjecting the fiber thus obtained to heat treatment.

DETAILED DESCRIPTION OF THE INVENTION

The polyester which exhibits anisotropy in its molten state referred to in this invention means one which has a property of allowing the transmission of light at a temperature region in which it is flowable when the powder sample of the polyester is placed on a heating sample stage positioned between two polarizing plates crossed at an angle of 90° and the temperature of the sample is increased. Such polyesters are those formed of aromatic dicarboxylic acids, aromatic diols and/or aromatic hydroxycarboxylic acid, and the derivatives thereof, disclosed in Japanese Patent Application Kokoku (Post-Exam. Publn.) Nos. 18016/81 and 20008/80, and optionally include copolymers of these with alicyclic dicarboxylic acids, alicyclic diols, aliphatic diols, and the derivatives thereof.

Examples of the aromatic dicarboxylic acids include terephthalic acid, isophthalic acid, 4,4'-dicarboxydiphenyl, 2,6-dicarboxynaphthalene, 1,2-bis(4-carboxyphenoxy)ethane, and the nuclear-substituted products thereof with an alkyl, aryl, alkoxy, or halogen group.

Examples of the aromatic diols include hydroquinone, resorcin, 4,4'-dihydroxydiphenyl, 4,4'-dihydroxybenzophenone, 4,4'-dihydroxydiphenylmethane, 4,4'-dihydroxydiphenylethane, 2,2-bis(4-hydroxyphenyl)propane, 4,4'-dihydroxydiphenyl ether, 4,4'-dihydroxydiphenyl sulfone, 4,4'-dihydroxydiphenyl sulfide, 2,6-dihydroxynaphthalene, 1,5-dihydroxynaphthalene, and the nuclear-substituted products thereof with an alkyl, aryl, alkoxy, and halogen group.

Examples of the aromatic hydroxycarboxylic acids include p-hydroxybenzoic acid, m-hydroxybenzoic acid, 2-hydroxynaphthalene-6-carboxylic acid, 1-hydroxynaphthalene5-carboxylic acid, and the nuclear-substituted products thereof with an alkyl, aryl, alkoxy, and halogen group.

Examples of alicyclic dicarboxylic acids include trans-1,4-dicarboxycyclohexane, cis-1,4-dicarboxycyclohexane and the substituted products thereof with an alkyl, aryl, and halogen group.

Examples of the alicyclic and aliphatic diols include trans-1,4-dihydroxycyclohexane, cis-1,4-dihydroxycyclohexane, ethylene glycol, 1,4-butanediol, and xylylene diol.

Among the combinations of the aforesaid materials, there may be mentioned as examples of a preferable aromatic polyester to be used in this invention:

(1) a copolyester comprising 40 to 70% by mole of p-hydroxybenzoic acid residue, 15 to 30% by mole of an above-mentioned aromatic dicarboxylic acid residue, and 15 to 30% by mole of an aromatic diol residue;

(2) a copolyester formed of terephthalic acid and/or isophthalic acid and chlorohydroquinone, phenylhydroquinone and/or hydroquinone; and (3) a copolyester comprising 20 to 80% by mole of p-hydroxybenzoic acid residue and 20 to 80% by mole o 2-hydroxynaphthalene-6-carboxylic acid residue.

To attain the polyesters to be used in this invention by using these starting materials, they are subjected to polycondensation as they are or after esterified by an aliphatic or aromatic monocarboxylic acid or the derivative thereof, or an aliphatic alcohol, a phenol, or the derivative thereof.

The polycondensation can be carried out by using a known method including mass polymerization, solution polymerization and suspension polymerization. It may be conducted at 150 to 360° C under normal pressure or a reduced pressure of 10 to 0.1 Torr optionally in the presence of polymerization catalyst such as a Sb, Ti and Ge compound, a stabilizer such as a phosphorus compound, and fillers such as $TiO_2$, $CaCO_3$, and talc, added thereto. The polymer thus obtained is heat-treated, as it is or in a pulverized form, in an inert gas or under reduced pressure to give a sample material for spinning. It can also be used after once granulated through an extruder.

The melt spinning apparatus to be used for the aromatic polyester according to this invention may be of any desired type so long as it is provided with a melting section such as a screw or a plunger equipped with a heat control device, a metering section such as a gear pump, and a spinning head including a spinneret.

Suitable temperature for spinning in this invention is 280° to 420° C., more preferably 300° to 400° C. Temperatures lower than the above-mentioned temperature region will result in too large load on the apparatus or insufficiency of uniform melting of the sample, whereas temperatures higher than the region will cause fiber breakage due to decomposition and foaming.

Although a conventional spinning nozzle can be used as it is, preferable spinneret include those having a hole diameter (d) of 0.3 mm or less and the ratio (l/d) of the hole length (l) to the hole diameter of 0.8 or more. Further, the breakage of single filaments and spiral extrusion can be prevented and effects of promoting orientation and suppressing foam generation in fibers can be exhibited by controlling the spinning pressure at the spinneret section at 3 $kg/cm^2G$ or more.

The fibers obtained by melt spinning as mentioned above are then taken up or drawn down as they are or after adhering a textile oil thereto. The velocity of taking up or drawing down is 10 to 10,000 m/minute, 100 to 2,000 m/minute being preferable from the viewpoint of productivity and stable spinning. The diameter and the shape of the section of the fiber to be obtained can be selected as desired according to intended uses. A diameter of 0.5 to 10 deniers is preferable from the viewpoint of physical properties.

The organic liquid heating medium to be used in this invention can be of any type so long as it does not undergo thermal decomposition at heat treatment temperature or chemical reaction with the polyester fiber to deteriorate the physical property of the fiber. For example, water, alcohols, acids, or the like are unsuitable since they can decompose the polyester fiber and cause the deterioration of its physical property.

Preferable organic liquid heating media are those which are liquid at room temperature, have a boiling point of about 150° C. or higher, more preferably 200° C. or higher, and have excellent thermal stability. Examples thereof include aromatic type heating media such as alkylnaphthalenes, dibenzyltoluene, diphenyl ether, monoethyldiphenyl, diethyldiphenyl, triethyldiphenyl, hydrogenated triphenyl, diphenyl, triphenyl, phenylxylylethane, and phenylnaphthalene; aliphatic type heating media such as paraffin; mineral oil-type heating media; silicone-type heating media such as straight chain methylsilicone oil, branched chain methylsilicone oil, methylphenylsilicone oil, and modified silicone oil. Particularly preferable among these are above-mentioned aromatic type heating media having a viscosity of 1 cp or less at a temperature of 250° C. from the viewpoint of penetration among filaments to be treated.

As to the method of treatment with organic liquid heating media, there can be used a method which comprises immersing in a heating medium consisting of at least one member selected from the above-mentioned organic liquid heating media the fibers, obtained by melt spinning, without tension or under tension in any desired form including strands, cords, or fibers wound round a bobbin. The heat treatment is carried out at 200 to 440° C., preferably 280 to 360° C., while the fiber is kept immersed in the heating medium. The treatment is conducted at normal pressure or, when the heating medium has a boiling point lower than the heat treatment temperature, under applied pressure of about 10 atm or less so as to keep the heating medium in the liquid state, for several minutes to several ten hours. The temperature and the time of heat treatment are suitably determined within the above-mentioned range in accordance with treatment conditions including polymer composition, spinning temperature, spinning velocity, denier, filament number, the form of the fiber in the heat treatment, the type of the heating medium, and pressure. When the time and the temperature of the heat treatment is lower than the lower limit of the above-mentioned range, the heat treatment does not exhibit a satisfactory effect; whereas when they exceed the upper limit of said range it causes thermal degradation of treated fibers.

In order to prevent the thermal degradation of the heating medium in heat treatment, it is preferable to use an atmosphere of inert gases such as $N_2$ or Ar.

When the fiber is to be heat-treated in a form wound round a bobbin, it is desirable to wind the fiber round the bobbin after adhering to the fiber the same heating medium as that used in the heat treatment by making it run along the surface of a smooth fixed nozzle such as an oiling nozzle guide or a roller surface covered with the heating medium during winding so that the heating medium may penetrate into the inner layer of the wound fiber. The bobbins preferably used are made of such metals as stainless steel, aluminum or brass so that they may not be decomposed or deteriorated at the heat treatment temperature, and perforated in such a form as a perforated plate or a mesh so as to allow the penetration of the heating medium into the fiber layer also from the inside of the bobbin.

The loading density can be selected as desired so long as it gives an amount of the heating medium sufficient for the medium to penetrate throughout the whole of the treated fiber immersed therein.

According to this invention, the heat treatment of the fiber may also be carried out after adhering to the fiber a solution or a suspension of a basic compound, organic polymer powder having a melting point or a softening temperature not lower than the heat treatment temperature, and powder of barium sulfate and/or barium titanate.

The solution or the suspension of a basic compound means herein a solution, preferably aqueous solution, and a suspension of at least one basic compound selected from the hydroxides, carbonates, bicarbonates, aliphatic acid salts having 6 or less carbon atoms, aromatic carboxylic acid salts, and aromatic phenol salts of alkali or alkaline earth metals. Examples of solvents which can be used in place of water are organic ones including methanol, ethanol, propanol, 2-methoxyethanol, 2-ethoxyethanol, dimethylformamide, and dimethyl sulfoxide. They can be used each alone or as a mixture of two or more thereof or, when miscible with water, also as a mixture with water.

The concentration of the basic compounds in the above-mentioned solution or suspension can be suitably selected in consideration of the kind of the solvent, heat treatment conditions and so forth but is preferably adjusted into the range of about 0.2 to 20% by weight, more preferably 0.5 to 10% by weight. When the concentration is lower than the lower limit of said range the effect of preventing fusion in the heat treatment is unsatisfactory, whereas when it exceeds the upper limit, ester linkages in the fiber are hydrolyzed, causing the deterioration of fiber properties. Further, a satisfactory effect cannot be obtained when a compound is used which will give a pH of aqueous solution of less than 8 when formed into the aqueous solution. The amount of the basic solution or suspension to be adhered is preferably in the range of 2 to 100% by weight relative to the fiber, although it varies also depending on their concentration.

As examples of organic polymers usable in this invention, mention may be made of aromatic polyester, polyamide, polyimide, polyamide-imide, polyketone, polyphenylene, phenol resin, silicone resin, and fluorocarbon resin.

An important point in this invention is that either the melting point or the softening temperature or both of them of these organic polymers to be adhered to the fiber are higher than the heat treatment temperature. When an organic polymer having a melting point and a softening point both lower than the heat treatment temperature is used, it can form a continuous phase on the fiber surface and sometimes promote the fusion of fibers.

The particle diameter of organic polymer powder to be used is preferably smaller than the diameter of the fiber to be treated from the viewpoint of dispersion of the powder into the space between fibers.

The methods of adhering organic polymer powder to the fiber include one comprising passing the fiber through a vessel or a tube containing the organic powder or on comprising adhering it by using a suspension of the organic polymer powder.

As the media for suspending the organic polymer powder in the above-mentioned method of using a suspension of organic polymer powder, there can be used water or organic solvents in which the solubility of the organic polymer is low, such as methyl alcohol, ethyl alcohol, propyl alcohol, butyl alcohol, amyl alcohol, acetone, methyl ethyl ketone, hexane, heptane, benzene, toluene, xylene, and carbon tetrachloride. Surface active agents and surface treating agents may also be added depending on necessity.

When the fiber made to run through organic polymer powder or a suspension thereof is a multi filament, it is also beneficial to obtaining the effect of this invention to spread the individual filaments by means of an expansion roll or the like.

When a suspension of organic polymer powder is used, the concentration of the organic polymer powder in the suspension is preferably 0.1 to 20% by weight.

The amount of organic polymer powder adhered to the fiber is preferably adjusted into the range of 0.1 to 100% by weight, more preferably 0.5 to 30% by weight, relative to the fiber after drying. When the amount is below the lower limit of said range the fusion prevention effect in the heat treatment is unsatisfactory, whereas when it exceeds the upper limit, the adhesion can be insufficient or the removal of the polymer is often difficult, which is uneconomical.

The average particle diameter of the powder of barium sulfate and/or barium titanate used in this invention is preferably not larger than one tenth of the average thread diameter of the aromatic polyester fiber to be heat-treated. When the average particle diameter is larger than one tenth of the average thread diameter, not only the suppression of the occurrence of fusion is insufficient but in some cases it can also damage the surface of the fiber and resultantly cause the deterioration of fiber properties during the steps of fiber production, for example the steps up to winding, and the steps of fiber processing. The smaller the average particle diameter of barium sulfate and barium titanate, the greater the effect of preventing the fusion of fibers in the heat treatment. However, since the prices of barium sulfate and barium titanate increase as their powders become more fine, they have preferably a particle diameter of 0.01 to 0.5 μm when an economical aspect is also taken into consideration.

As to the method of adhering the powder of barium sulfate or barium titanate to fiber, there can be mentioned, for example, a method of passing the fiber through these powders or through a gas in which the powders are being floated or fluidized or a method of using a suspension of the powder of barium sulfate or barium titanate. The method of using the suspension of the powder of barium sulfate or barium titanate is more preferable.

As the media for suspending the powder of barium sulfate or barium titanate, there can be used water or organic solvents in which the solubility of barium sulfate or barium titanate is low, such as methyl alcohol, ethyl alcohol, propyl alcohol, butyl alcohol, amyl alcohol, acetone, methyl ethyl ketone, hexane, heptane, benzene, toluene, xylene and carbon tetrachloride. Surface active agents and surface treating agents can also be used depending on necessity.

When the suspension of barium sulfate powder or barium titanate powder is used, the concentration of the suspension is preferably 0.05 to 20% by weight.

When the suspension of the powder of barium sulfate or barium titanate has been adhered to the fiber, it is preferable to wind the fiber round a bobbin after removing water or organic solvents by drying. A great fusion prevention effect is obtained as compared with a case where the fiber is wound without said removal.

The amount of the powder of barium sulfate or barium titanate adhered to the fiber by using various methods mentioned above is desirably adjusted into the range of 0.05 to 100% by weight, preferably 0.5 to 30% by weight, and more preferably 1 to 5% by weight, relative to the weight of dried fiber. The control of the amount adhered to the fiber can be effected by varying the time of contact or immersion of the fiber with or in the powder of barium sulfate or barium titanate or the suspension thereof; changing the concentration of the suspension; controlling the amount mechanically after adhesion by means of a squeezing roller and the like; or applying vibration to the thread. When the amount is below the lower limit of the above-mentioned range the fusion prevention effect in the heat treatment of the fiber can be insufficient, whereas when it exceeds the upper limit, not only it is uneconomical but it can make the removal of the powder of barium sulfate or barium titanate difficult and resultantly affect the feeling or the physical property of the fiber.

The fiber thus obtained having a basic compound, organic polymer powder, barium sulfate powder and/or barium titanate powder adhered thereto is then heat-treated as it is or after being dried. The heat treatment is preferably conducted at a temperature of 200° to 440° C., preferably 280° to 360° C., for several minutes to several ten hours under a vacuum of 100 mmHg or less, or in the air or in an atmosphere of inert gas, or in the above-mentioned organic heating medium having a boiling point not lower than the heat treatment temperature. In this manner the heat treatment can be effectively conducted without the problem of occurrence of fusion. The fiber thus heat-treated is, as desired, cooled and then washed and dried.

The fiber thus obtained shows no phenomenon of fusion and can be used in a wide field of applications including tire cords, ropes, cables, the tension member of FRP, FRTP, FRC and FRM, speaker cones, bullet-proof vests, space suits, and submarine working clothes.

EXAMPLE

Some embodiments of this invention will be described below to make this invention more clearly understood. However, these are merely for the sake of illustration and the essentials of this invention are not limited thereby. The characteristic values shown in the Examples were measured and calculated in the following manner.

(1) Flow Temperature of Polymer

A Flow Tester CFT-500 (mfd. by Shimadzu Corp.) was used with a nozzle having a diameter of 1 mm and a length of 10 mm. An organic polymer sample was kept under a pressure of 100 kg/cm$^2$ and heated to increase its temperature at a rate of 4° C./min. The flow temperature was defined as the temperature at which the sample flowing through the nozzle shows an apparent viscosity of 96000 poises.

(2) Optical Anisotropy

A sample was placed on a heating stage and observed with the naked eye under polarized light while the temperature of the sample was increased at a rate of 25° C./min.

(3) Tensile Test

The test was conducted by using a Tension Type II (a trade name, mfd. by Toyo Baldwin Co. Ltd.) with a specimen gap of 20 mm and a stretching velocity of 2 mm/min. The number of specimens was 24. The result of determination was expressed in terms of the mean value excluding the maximum and the minimum measured value. The variance of strength is the value obtained by dividing standard deviation by the mean value.

(4) Strand Strength (g/d)

A fiber bundle formed of 100 fibers of 3d after heat treatment was impregnated thoroughly with an epoxy resin XD911 (mfd. by Ciba Geigy Co.), and the mixture was passed through a squeezing rollers, and solidified by allowing it to hold at 25° C. for 12 hours to prepare a specimen (specimen length: 200 mm, fiber content: 50%).

The strand strength was determined with this specimen by using a universal testing machine No. 1115 (mfd. by Instron Co.) at a stretching velocity of 0.5 mm/min. The number of specimens was 12, and the mean of ten measured values was calculated excluding the maximum and the minimum value.

(5) Fusion Degree (f)

A sample prepared by cutting a fiber bundle after heat treatment to a length of 20 mm was subjected to ultrasonic waves for 20 minutes in water by using an ultrasonic creator to be dispersed in water. The total number (n) of single filaments and fiber fragments (formed of 2 to several single filaments fused together) dispersing in water was determined, and the fusion degree was calculated according to the following equation. The indicated value is the mean of values determined for 10 test materials collected randomly from a cheese after heat treatment.

$f=N/n$ (N indicates the number of single filaments before heat treatment)

REFERENTIAL EXAMPLE

Into a polymerization vessel having a comb-type stirrer, were placed 7.20 kg (40 moles) of p-acetoxybenzoic acid, 2.49 kg (15 moles) of terephthalic acid, 0.83 kg (5 moles) of isophthalic acid, and 5.45 kg (20.2 moles) of 4,4'-diacetoxydiphenyl, and the resulting mixture was brought to elevated temperature with stirring under a nitrogen gas atmosphere and polymerized at 330° C. for 3 hours. During the period, acetic acid formed was removed and the polymerization was carried out with powerful stirring. Thereafter, the system was gradually cooled and the polymer formed was taken out at 200° C. from the system. The yield of polymer was 10.88 kg, 97.8% of theoretical yield. The polymer was pulverized in a hammer mill to give particles of 2.5 mm or less. The polymer powder was then treated in a rotary kiln in nitrogen atmosphere at 280° C. for 5 hours. The resulting product gave a "flowing temperature" of 326° C. and showed optical anisotropy at a temperature of 350° C. or higher.

The polymer obtained above was melt-spun by using a 30 mm extruder. The spinneret used had a hole diameter of 0.07 mm, a hole length of 0.14 mm and a number of holes of 100. The spinning temperature at the spinneret was 355° C.

The fiber obtained having a diameter of 17 μm was wound round a bobbin at a take-up velocity of 300 m/min.

EXAMPLE 1 AND COMPARATIVE EXAMPLE 1

The cheese of the fiber obtained in Referential Example was immersed in hydrogenated triphenyl contained in a stainless steel vessel, then placed together with the vessel in an oven under nitrogen atmosphere, and heat-treated at 320° C. for 12 hours. The fiber after the heat treatment was washed thoroughly with toluene and then dried.

By way of a Comparative Example, another cheese was heat-treated in nitrogen atmosphere at 320° C. for 12 hours without being immersed in the heating medium.

Characteristic values were determined with the two kinds of fibers obtained above, and the results are shown in Table 1 below together with the results of fibers as spun.

TABLE 1

| | Fusion degree (f) | Strand strength (g/d) |
|---|---|---|
| Example 1 | 1.09 | 25.4 |
| Comparative Example 1 | 2.43 | 19.2 |
| Fibers as spun | 1.00 | 10.0 |

EXAMPLE 2 AND COMPARATIVE EXAMPLE 2

The fiber obtained in Referential Example was reeled into hanks each weighing 20 g. Aqueous sodium hydroxide solutions having various concentrations shown in Table 2 below were then adhered to the fiber in a proportion of 20% by weight relative to the fiber, and the fiber was heat-treated in nitrogen atmosphere at 340° C. for 10 hours.

Characteristic values were examined with the resulting fibers and the results are also shown in Table 2.

TABLE 2

| Run No. | Sodium hydroxide concentration (% by weight) | Fusion degree (f) | Strength (g/d) |
|---|---|---|---|
| 1 (Comp. Example 2) | 0 | 2.85 | 11.3 |
| 2 (Comp. Example 2) | 0.1 | 2.62 | 14.0 |
| 3 (Example 2) | 0.2 | 1.83 | 20.2 |
| 4 (Example 2) | 0.5 | 1.54 | 22.6 |
| 5 (Example 2) | 1.0 | 1.02 | 25.9 |
| 6 (Example 2) | 10.0 | 1.00 | 22.7 |
| 7 (Example 2) | 15.0 | 1.00 | 16.3 |
| 8 (Comp. Example 2) | 30.0 | 1.00 | 3.8 |

The above table clearly reveals the fact that aromatic polyester fibers of high strength and with no fusion can be produced by adopting the method of this invention (Nos. 3 to 7). Lower strength is observed in Comparative Example 2 (Run Nos. 1 and 2) because a marked fusion has occurred therein and resultantly the fiber has been injured when separated into single filaments for the tensile test, and in Comparative Example 2 (Run No. 8) because the fiber has undergone hydrolysis.

EXAMPLE 3

The fiber obtained in Referential Example was passed through a 5% suspension of aromatic polyester powder in ethyl alcohol and wound round a bobbin. The aromatic polyester used was Ekonol E-101 (a trade name, mfd. by Sumitomo Chemical Co., Ltd.) (average particle diameter 4 μm). The polyester has neither a melting point nor a softening temperature up to 400° C. The running time of the fiber in said suspension was 20 seconds, said suspension being vibrated by means of ultrasonic waves. The treated fiber was dried, and the amount of aromatic polyester powder adhered to the fiber was examined and found to be 3.9%. The fiber was heat-treated in the form wound round a bobbin in nitrogen gas at 320° C. for 6 hours. The fusion degree (f) was 1.00, no fusion being observed between filaments. The fiber strength was 28.8 g/d, the variance of strength was 12.6%, the elongation of the fiber was 2.5%, and the modulus of elasticity was 1,160 g/d.

COMPARATIVE EXAMPLE 3

The procedures of Example 3 were repeated except that ethyl alcohol containing no aromatic polyester powder was used, to make the fiber run through ethyl alcohol and then dried. The fiber obtained was heat-treated at 320° C. for 6 hours in the same manner as in Example 3. The fusion degree (f) was 2.63 and thus fusion was observed. The fiber strength was 20.3 g/d, and the variance of strength was as high as 19.7%. This is presumably because the fiber has been damaged during the collection of samples.

EXAMPLE 4

A dry fiber having polyimide powder adhered thereto was obtained in the same manner as in Example 3 except that a 5% suspension of polyimide powder in ethyl alcohol was used. The polyimide was synthesized from 4,4'-diaminodiphenyl ether and pyromellitic anhydride, and has neither a melting point nor a softening temperature up to 400° C. The average particle diameter of the polyimide was 8 μm. The amount of polyimide adhered to the treated fiber was 3.7%. When the fiber was heat-treated in nitrogen gas at 320° C. for 6 hours, it showed a fusion degree (f) of 1.02. The fiber strength was 27.2 g/d and the variance of strength was 12.8%, both being markedly more excellent than those in Comparative Example 3.

EXAMPLE 5

The organic polymer used was a polyamideimide prepared from 4,4'-diaminodiphenyl ether and trimellitic anhydride. It has an average particle diameter of 5 μm, and has neither a melting point nor a softening temperature up to 400° C.

The fiber obtained in Referential Example was used to adhere said polyamide-imide powder to the fiber surface in the same manner as in Example 3. The amount adhered was 4.0%.

The resulting fiber was heat-treated in nitrogen gas at 320° C. for 6 hours. The treated fiber gave a fusion degree (f) of 1.06, a strength of 27.0 g/d and a variance of strength of 13.2%, and thus was markedly more excellent than the fiber obtained in Comparative Example 3.

COMPARATIVE EXAMPLE 4

The polymer used was nylon 66, which was subjected to dissolution and reprecipitation to obtain a powder having an average particle diameter of 9 μm and a melting point of 258° C. The powder was suspended in a concentration of 5% in ethyl alcohol and adhered to the fiber in the same manner as in Example 3. The amount of the adhered powder after drying was 4.3%. The resulting fiber was treated in nitrogen gas at 320° C. for 6 hours. The fusion degree (f) of the fiber obtained was 4.76, being worse even as compared with that in Comparative Example 3.

EXAMPLE 6

The same aromatic polyester powder as that used in Example 3 was placed in a plastic vessel. The fiber obtained in Referential Example was used to be made to run through said powder at a velocity of 100 cm/min. An expansion roll made of silicone rubber was provided at the inlet of the plastic vessel to open the multifilament so as to improve the contact between the fiber and the powder. The amount of the powder adhered to the fiber was 9.1%. The resulting fiber was heat-treated in nitrogen gas at 320° C. for 6 hours in the same manner as in Example 3. The fiber obtained showed a fusion degree (f) of 1.2, a fiber strength of 27.6 g/d; and a variance of strength of 12.8%.

EXAMPLE 7 AND COMPARATIVE EXAMPLE 5

Continuous fiber obtained in Referential Example was used. It was made to run through a suspension of barium sulfate powder in ethyl alcohol, the particle diameter and the concentration of the powder in said suspension being varied. The fiber was then exposed to hot air to remove ethyl alcohol and wound round a stainless steel bobbin each in a weight of about 1 kg. The barium sulfate powders used were "Barifine" (a registered trade name) and "precipitated barium sulfate" (mfd. by Sakai Chemical Industry Co., Ltd.), four kinds in all, having different particle diameters. The running time of the fiber in the suspension was 20 seconds. The container of the suspension was fixed in an ultrasonic wave generator to enhance the dispersion of barium sulfate powder in the suspension. Eight kinds of fiber wound round a bobbin were treated in nitrogen gas at 320° C. for 3 hours, and the results are shown in Table 3. Further, results obtained by running the fiber in ethyl alcohol without using barium sulfate of this invention are also shown as Comparative Example.

Table 3 reveals that the fibers of Examples according to this invention show no or virtually no fusion, have a high strength, and show little scattering of the data of strength.

TABLE 3

| Example No. | Average particle diameter of barium sulfate powder (μm) | Concentration of suspension (% by weight) | Amount of barium sulfate adhered to fiber (% by weight) | Fusion degree of fiber (f) | Tensile strength of fiber (g/d) | Variance of strength of fiber (%) |
|---|---|---|---|---|---|---|
| Example 7-1 | 10 | 5 | 4.2 | 1.24 | 17.8 | 15.7 |
| " 7-2 | 2 | 5 | 4.8 | 1.11 | 25.9 | 13.2 |
| " 7-3 | 0.5 | 5 | 5.0 | 1.02 | 28.2 | 12.0 |
| " 7-4 | 0.03 | 5 | 5.4 | 1.00 | 30.5 | 10.4 |
| " 7-5 | 0.03 | 0.5 | 0.5 | 1.05 | 30.8 | 12.3 |
| " 7-6 | 0.03 | 0.06 | 0.08 | 1.43 | 25.6 | 16.1 |
| " 7-7 | 0.03 | 0.03 | 0.02 | 2.00 | 23.2 | 17.8 |
| Comparative Example 5 | Not used | 0 | 0 | 2.63 | 20.3 | 19.7 |

EXAMPLE 8

The fiber obtained in Referential Example was used in the same manner as in Example 7 except that the powder of barium titanate was used in place or that of barium sulfate. The powder had an average particle diameter of 0.25 μm. The amount of barium titanate adhered to the fiber after drying was 3.1%. The fiber after heat treatment showed a fusion degree (f) of 1.05, a strength of 28.9 g/d and a variance of strength of 11.8%.

What is claimed is:

1. A process for producing an aromatic polyester having high strength and high modulus of elasticity by heat-treating a fiber obtained by melt-spinning an aromatic polyester exhibiting anisotropy in its molten state without the problem of occurrence of fusion among filaments which process comprises adhering to the fiber obtained by melt spinning an organic polymer powder from a suspension of organic polymer powders having a concentration of 0.1 to 20% by weight and a particle diameter smaller than the diameter of the fiber and having a melting point or a softening temperature higher than the heat treatment temperature wherein the amount adhered to the fiber is from 0.1 to 100% by weight, wherein the media for suspending the organic polymer powder consists of water or organic solvents in which the solubility of the organic powder is low and then subjecting the fiber thus obtained to heat treatment.

2. The process according to claim 1 wherein the aromatic polyester is selected from the group consisting of (1) a copolyester comprising 40 to 70% by mole of p-hydroxybenzoic acid residue, 15 to 30% by mole of an aromatic dicarboxylic acid residue, and 15 to 30% by mole of an aromatic diol residue;

(2) a copolyester formed of terephthalic acid, isophthalic acid or mixtures thereof and at least one member selected from the group consisting of chlorohydroquinone, phenylhydroquinone and hydroquinone; and (3) a copolyester comprising 20 to 80% by mole of p-hydroxybenzoic acid residue and 20 to 80% by mole of 2-hydroxynaphthalene-6-carboxylic acid residue.

3. A process for producing an aromatic polyester fiber by heat-treating a fiber obtained by melt spinning an aromatic polyester exhibiting anisotropy in its molten state which process comprises adhering to the fiber obtained by melt spinning 0.05 to 100% by weight of barium sulfate powder or barium titanate powder from a suspension of barium sulfate powder or barium titanate powder having a concentration of 0.05 to 20% by weight and having an average particle diameter of the powder which is not more than one-tenth of the average thread diameter of the fiber, wherein the media for suspending the powder of barium sulfate or barium titanate consists of water or organic solvents in which the solubility of barium sulfate or barium titanate is low, and then subjecting the fiber thus obtained to heat treatment.

4. The process according to claim 3 wherein the aromatic polyester is selected from the group consisting of (1) a copolyester comprising 40 to 70% by mole of p-hydroxybenzoic acid residue, 15 to 30% by mole of an aromatic dicarboxylic acid residue, and 15 to 30% by mole of an aromatic diol residue;

(2) a copolymer formed of terephthalic acid, isophthalic acid or mixtures thereof and at least one member selected from the group consisting f chlorohydroquinone, phenylhydroquinone and hydroquinone; and (3) a copolyester comprising 20 to 80% by mole of p-hydroxybenzoic acid residue and 20 to 80% by mole of 2-hydroxynaphthalene-6-carboxylic acid residue.

* * * * *

UNITED STATES PATENT AND TRADEMARK OFFICE

CERTIFICATE OF CORRECTION

PATENT NO. : 4,865,790

DATED : SEPTEMBER 12, 1989

INVENTOR(S) : Hiroaki SUGIMOTO et al

It is certified that error appears in the above-identified patent and that said Letters Patent is hereby corrected as shown below:

TITLE PAGE,

IN THE ABSTRACT

Line 12, change "0.05" to -- 0.1 --;

Line 15, change, "0.1" to -- 0.05 --.

Claim 1, line 1, after "polyester" insert -- fiber --.

Signed and Sealed this

Eleventh Day of June, 1991

*Attest:*

HARRY F. MANBECK, JR.

*Attesting Officer*

*Commissioner of Patents and Trademarks*